US008803107B2

(12) United States Patent
Delpech et al.

(10) Patent No.: US 8,803,107 B2
(45) Date of Patent: Aug. 12, 2014

(54) MATERIAL ABSORBING ELECTROMAGNETIC WAVES

(76) Inventors: Marc Delpech, Vienna, VA (US); Christian Lhomme, St Lyphard (FR)

( * ) Notice: Subject to any disclaimer, the term of this patent is extended or adjusted under 35 U.S.C. 154(b) by 0 days.

(21) Appl. No.: 13/882,777

(22) PCT Filed: Nov. 3, 2011

(86) PCT No.: PCT/FR2011/052567

§ 371 (c)(1), (2), (4) Date: May 1, 2013

(87) PCT Pub. No.: WO2012/059694

PCT Pub. Date: May 10, 2012

(65) Prior Publication Data

US 2013/0214181 A1 Aug. 22, 2013

(30) Foreign Application Priority Data

Nov. 5, 2010 (FR) ..... 10 59141

(51) Int. Cl.
*G21F 1/12* (2006.01)
*H01B 1/22* (2006.01)

(52) U.S. Cl.
USPC ..... 250/487.1; 250/488.1; 250/515.1; 250/516.1; 343/851; 342/1

(58) Field of Classification Search
CPC ..... H01B 1/22; H01Q 17/002; H01Q 15/163; H01Q 17/005
USPC ..... 250/515.1, 516.1, 487.1, 488.1; 343/851; 342/1
See application file for complete search history.

(56) References Cited

U.S. PATENT DOCUMENTS

| | | | | |
|---|---|---|---|---|
| 5,576,710 | A * | 11/1996 | Broderick et al. | 342/1 |
| 7,495,181 | B2 * | 2/2009 | Matsushita et al. | 174/377 |
| 2009/0027279 | A1 * | 1/2009 | Choi et al. | 343/702 |
| 2009/0135042 | A1 * | 5/2009 | Umishita et al. | 342/1 |

FOREIGN PATENT DOCUMENTS

| | | | |
|---|---|---|---|
| EP | 1796450 | A1 | 6/2007 |
| FR | 656146 | A | 4/1929 |
| FR | 2678132 | A1 | 12/1992 |
| FR | 2716964 | A1 | 9/1995 |
| FR | 2928778 | A1 | 9/2009 |

OTHER PUBLICATIONS

International Search Report issued Feb. 1, 2012 re: PCT/FR2011/052567; pp. 4; citing: US 7,495,181 B2, US 2009/027279 A1 and US 5,576,710 A.

* cited by examiner

*Primary Examiner* — Nikita Wells
(74) *Attorney, Agent, or Firm* — Cantor Colburn LLP

(57) ABSTRACT

The invention relates to a material that absorbs electromagnetic waves, characterized in that it includes at least one textile layer printed using at least one conductive ink in accordance with at least one pattern including printed areas and non-printed areas in an arrangement suitable for a corresponding range of absorption frequencies.

21 Claims, 5 Drawing Sheets

MATERIAL ABSORBING ELECTROMAGNETIC WAVES

TECHNICAL FIELD

The invention relates to a metamaterial for applying an absorbent screen towards electromagnetic radiation, notably in the field of ultra high frequencies, super high frequencies and extremely high frequencies.

BRIEF DESCRIPTION OF RELATED ART

The increasingly frequent use of appliances emitting electromagnetic waves in many fields of applications, and notably, i.e., in the fields of telecommunications, aviation, health care, makes the capability increasingly significant of being able to isolate certain objects selectively from undesired electromagnetic radiations propagating in their environment.

For example, it may be desirable to efficiently isolate certain portions of the body of a patient from electromagnetic radiation emitted by a scanner appliance for example, so that only the targeted area of the body is exposed to electromagnetic radiation. This for example is the case of patients having undergone surgical operations following which, metal elements, such as pins, plates, etc., have been implanted and which cannot be subject to a scanner. It might thus be desirable to magnetically isolate this portion of the body.

It may even be desirable to conceal objects so that they do not reflect these electromagnetic waves and thus do not generate parasitic radiations or perturb measuring instruments, such as radars for example. This for example is the case of wind turbines which, because of their rotating vanes may generate parasitic signals on meteorological or air control radar screens. A simpler modification of the signature of these objects may desirably be envisaged so that their signature corresponds to a more clearly identified object.

Mention may further be made of the application of directional transmitters or with variable emission powers versus direction. This is notably the case for mobile telephone antennas for example, for which it would be desirable to suppress (shield) or at least strongly weaken the rear emission and secondary lobes. Such a characteristic would be particularly advantageous for mobile telephone antennas placed on the roofs of buildings or facing dwellings.

The characteristics of the desired shielding may be extremely variable, notably in the shape of the object to be isolated, the temporary or permanent duration of the isolation, as well as in the sought attenuated power; for example, there exists a need for a solution giving the possibility of providing a material absorbing electromagnetic waves which may adopt a maximum of possible configurations and notably having certain ease in its implementation.

Presently, existing materials absorbing radar waves may be sub-divided into four categories, i.e.:

- «Quarter wave» materials: the surface of the airplane (or of another object) is covered with a special coating; there is reflection of two phase-shifted waves, one reflected by the body and the other one by the coating, which cancel out when they are added; ideally, the coating and the body each reflects half of the incident wave and are separated by a distance equivalent to a quarter of the wavelength, which ensures that there is a reflection of two waves of opposite phase, which totally cancel out when they are added. This principle is also used for anti-reflective lenses. A drawback: the «quarter wave» material operates well for a single specific wave length and its efficiency decreases all the more so since the incident wave length is far from this ideal length.
- Materials absorbing the incident wave by energy conversion: the material transforms the radar waves into infrared waves, so that there is no reflected wave. The materials are carbons or resins into which ferrites modifying the frequency of the wave are embedded.
- Materials with successive phase shifting/absorbing layers: successive layers of the two materials above for which resistivity decreases gradually. This allows absorption of waves with multiple wave lengths.
- Materials with impedance homogeneity: the higher are the impedance differences between air (or another medium) and the materials, the more these materials reflect radar waves; the ideal coating therefore consists of successive layers for which impedance increases gradually. In practice, these coatings consist of molded dielectric material with the shape of small pyramids.

All these materials are often heavy, and/or thick, and/or brittle, and/or limited to a relatively narrow frequency range.

As examples of the prior art, reference may be made to the documents mentioned hereafter.

Document FR 2 678 132 describes a screen absorbing electromagnetic radiation having a planar honeycomb structure loaded with carbon and having an impedance gradient which varies according to thickness. The application of a honeycomb structure makes the material particularly brittle and relatively not very adaptable to any type of surface, notably to curved surfaces.

Document FR 2 716 964, as for it, proposes the application of an openworked web according to a predetermined pattern, which therefore remains complex to apply.

Document FR 6 56 6146 proposes an absorbing material comprising an absorbing layer in polymer fibers, the electric conductivity of which has been adjusted by a pyrolysis treatment under a controlled atmosphere. Such a material is therefore not very adaptable and particularly complex to apply.

Document FR 2 928 778 discloses a multilayer absorbing material and the layers of which are made from a syntactic foam loaded with a conductive material. Because of the application of foam, such a material has non-negligible thickness and quite relative flexibility.

Document EP 1 796 450 describes a multilayer absorbing material comprising an insulating layer placed between a conducting layer and an upper conducting layer forming a scheme for absorbing electromagnetic waves, the layers being laminated together. The application of such a material therefore remains relatively complex.

BRIEF SUMMARY

The present invention aims at allowing the manufacturing of a thin material absorbing electromagnetic waves having great ease in its implementation and use.

To do this, the present invention relates to a material absorbing electromagnetic waves, characterized in that it comprises at least one printed textile layer by means of at least one conductive ink in accordance with at least one pattern comprising printed areas and non-printed areas, in an arrangement adapted to a corresponding range of absorption frequencies.

Thus, by printing the conducting layer and absorbing patterns directly on a textile layer, it is possible to obtain a not very thick, flexible, relatively simple material and fast to manufacture and adapt, the desired absorbing patterns may easily be printed directly.

Advantageously, the conductive ink is an ink based on carbon black. More particularly it may be an aqueous ink based on carbon nanoparticles, preferentially with a size of about 300 angstroms. With such an ink, it is possible to obtain relatively high conductivity with a low printing load on the textile.

Preferentially, the printed layer has a conductivity comprised between 300 and 1,000 ohms/square.

The thickness of the print will advantageously be of about 100 μm.

Preferentially, the print pattern of the fabric is a recurrent pattern.

Still preferentially, the printed pattern results from the intersected printing of lines with determined thicknesses and spaced apart, oriented in at least two directions, notably perpendicular directions.

Advantageously, the non-printed areas form rectangles and notably comprise squares.

The pattern and the dimensions of the non-printed areas will of course be adapted to the wavelength or to the range of wavelengths to be attenuated or absorbed. Thus, in a known way, wide patterns will give the possibility of absorbing waves with longer wavelengths and therefore with low frequencies. Conversely, patterns of small sizes will give the possibility of absorbing shorter waves and therefore with higher frequencies.

According to a preferred embodiment, the printed textile is a non-woven textile. Advantageously, this is a microfiber textile, advantageously with polymer fibers, notably imparting strength, long lastingness, toughness and durability.

As an example of a textile which may be used, mention may be made of the fabric Sontara® marketed by Dupont de Nemours. Of course it will be possible to use any other type of suitable textile, notably fabrics in glass fibers or plant fibers of the bamboo fiber type.

Advantageously, the material comprises a plurality of printed layers, notably according to patterns different from each other. The application of several printed layers allows absorption of a wider range of frequencies and may notably give the possibility of letting through frequencies belonging to a given range of frequencies. The multilayer configuration also gives the possibility of making the material not very sensitive or even insensitive to the direction of polarization of the received waves.

Preferentially, the printed layer(s) is(are) printed on a surface intended to receive an incident flux of electromagnetic waves.

Advantageously, the material comprises at least one dielectric supporting layer intended to be positioned towards the inside of the material, the received electromagnetic waves being intended to first cross the printed layer(s).

According to a preferred embodiment, the supporting layer is a polymeric film, notably of the polyethylene terephthalate type.

Alternatively, complementarily, the supporting layer is made from a ventilated three-dimensional textile.

Complementarily and advantageously, the supporting layer may be electrically powered with low voltage.

In order to provide an anti-lightning material, the supporting layer is impregnated with at least one conducting material, notably nickel for example.

Preferentially, the material comprises at least one outer shell layer notably of the polyamide textile type.

Advantageously, the material comprises at least one printed layer, which is printed on a surface intended to be oriented towards the inside of the fabric. Depending on the attenuation performances of the upper printed layers, the attenuated electromagnetic wave may be reflected by the supporting layer and give rise to emission of a reflected electromagnetic wave, no doubt extremely attenuated and weakened, but existent. Thus, depending on the desired attenuation and performances, it is possible to position a printed layer oriented towards the supporting layer in order to further attenuate the electromagnetic wave possibly reflected by the supporting layer.

Preferentially, all or part of the adjacent printed layers are separated from each other by at least one intercalated layer. Advantageously, the intercalated layer is a cellular layer, notably a textile, for example tulle.

Moreover, the present invention relates to a composite material characterized in that it comprises at least one material according to the invention. Indeed, the whole of the printed layers may be used with notably one resin.

The present invention further relates to a device characterized in that it comprises at least one surface covered with at least one material according to the invention.

BRIEF DESCRIPTION OF THE DRAWINGS

The present invention will be better understood in the light of the detailed description which follows with reference to the appended drawing wherein.

DETAILED DESCRIPTION

Figure 1:
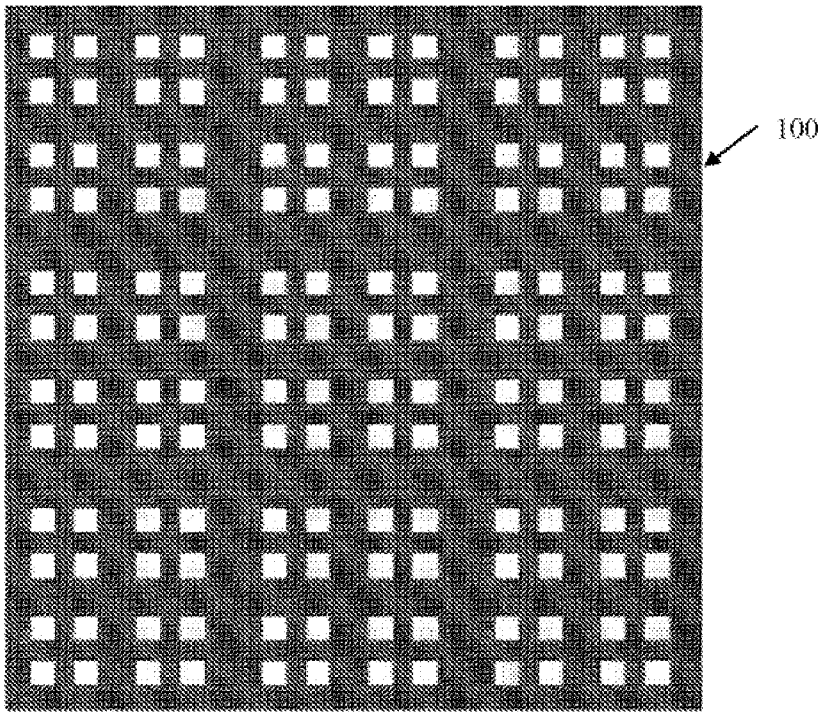
FIGS. 1 to 6 show examples of printed layers according to the invention having different print patterns.

FIG. 1 shows a material 100 according to the invention comprising a printed textile layer, notably by screen printing, by means of at least one conductive ink, preferentially an aqueous ink, based on carbon particles of about 300 angstroms.

The textile layer used is a non-woven textile marketed under the name of Sontara® by Dupont de Nemours having a thickness of 0.22 mm.

The textile layer comprises printed areas and non-printed areas; these are non-printed areas appearing as substantially rectangular two-dimensional periodic patches.

More specifically, the patterns of the textile layer are in this case obtained by intersected printing of lines with determined thicknesses, spaced apart, and oriented perpendicularly.

Thus, the pattern illustrated in FIG. 1 results from the repeated printing of a thick line (with a thickness e), of a thin line (thickness e/4), of a medium line (thickness e/2), and of a new thin line, each line being spaced apart from its neighbors regularly with a given thickness (equal to or different from e).

This pattern is printed along perpendicular directions, the lines of each pattern intersecting with each other.

The result thereof is a set of non-printed areas appearing as a block of four regularly positioned squares, the side length of each square being substantially equal to the spacing thickness between the lines.

By varying the thicknesses of lines and the patterns, as well as the spacing of the lines, it is possible to obtain different patterns notably comprising rectangles, and thereby forming different layers such as illustrated in FIGS. 2 to 6.

More specifically, a set of linear antennas oriented along at least two directions is obtained, the size of the patterns and of non-printed areas being calculated according to the frequencies to be attenuated.

Figure 2:
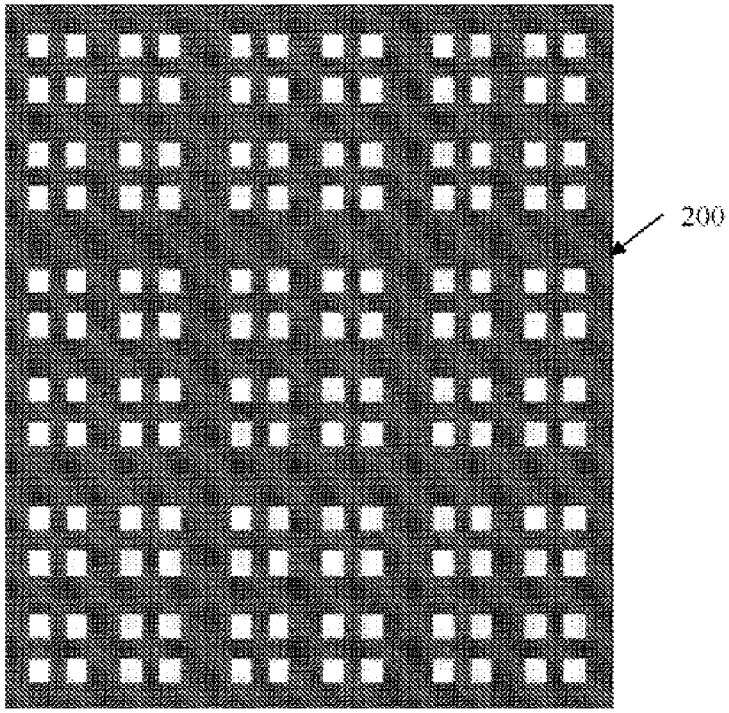

FIG. 2 shows a material 200 comprising a printed layer similar to FIG. 1, in which the initial 4-sided regular polygon geometrical pattern has been modified as a simple rectangular quadrilateral so as to obtain substantially constant resistivity during screen printing and consequently, better isotropy of the final system.

Figure 3:
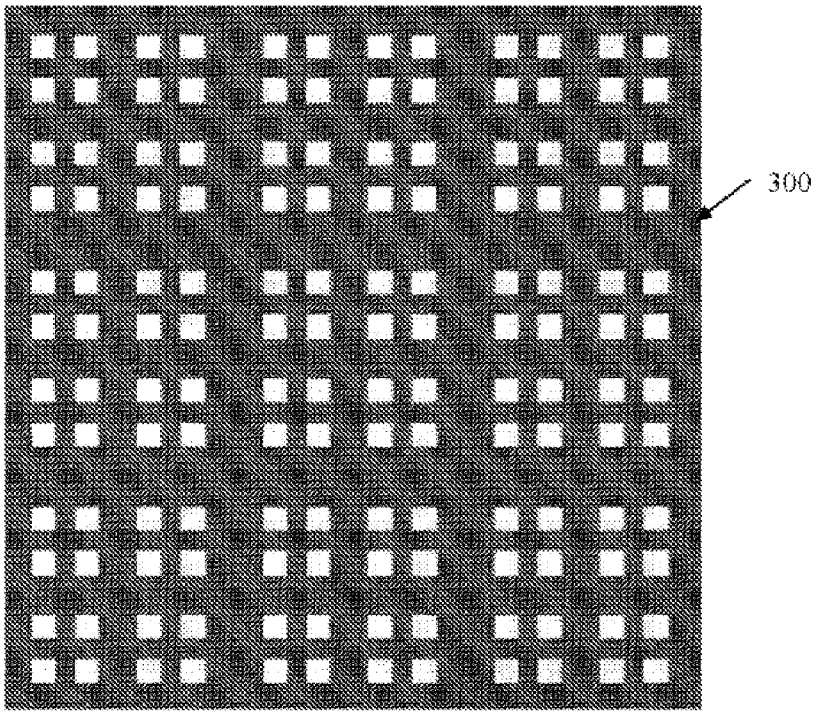

FIG. 3 shows a material 300 comprising a printed layer, the patterns of which have been optimized for low frequencies, notably by providing wider patterns.

Figure 4:
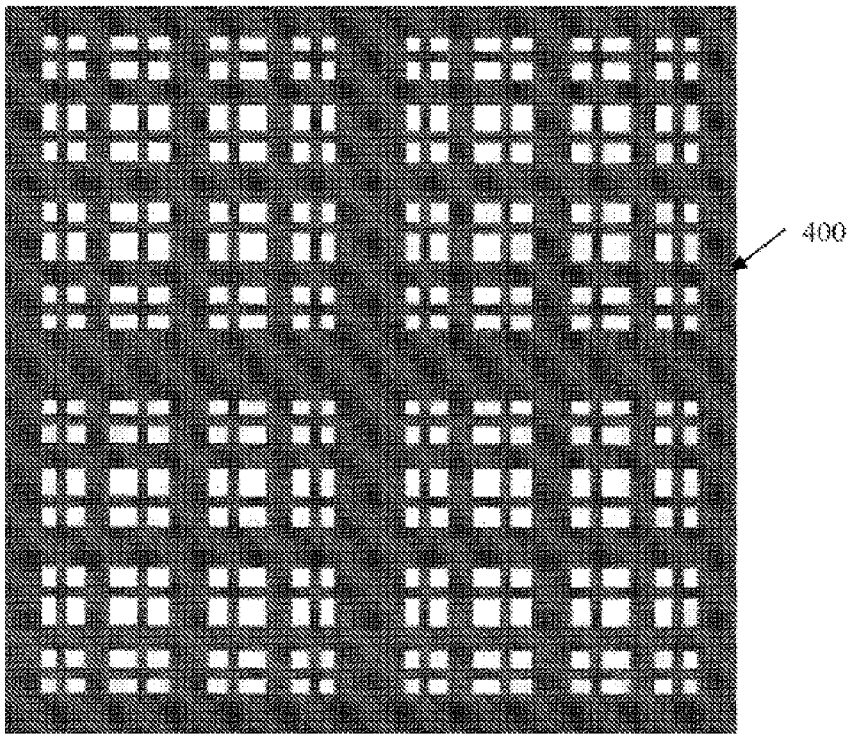

FIG. 4 shows a material 400 comprising a printed layer having non-printed areas both with square and rectangular shapes according to various sizes. The range of frequencies covered by this pattern is therefore larger.

Figure 5:
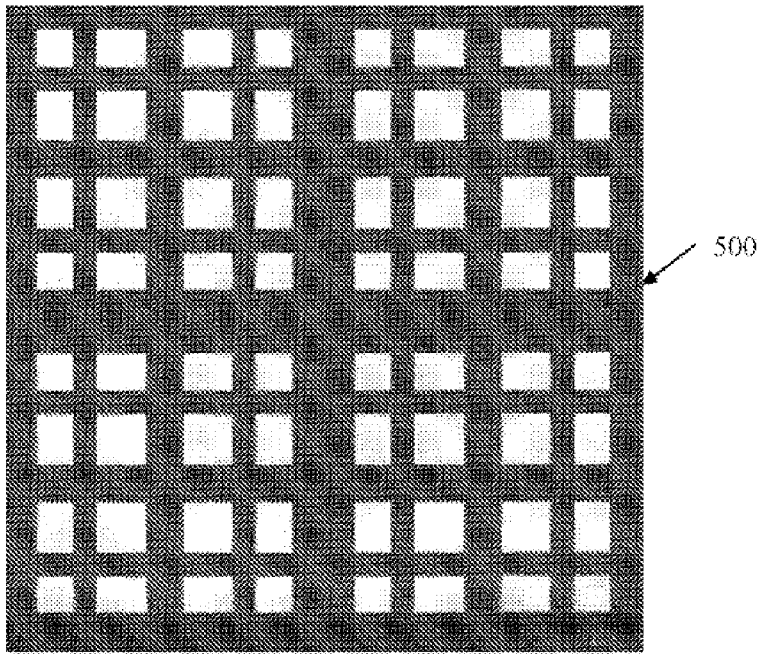
Figure 6:
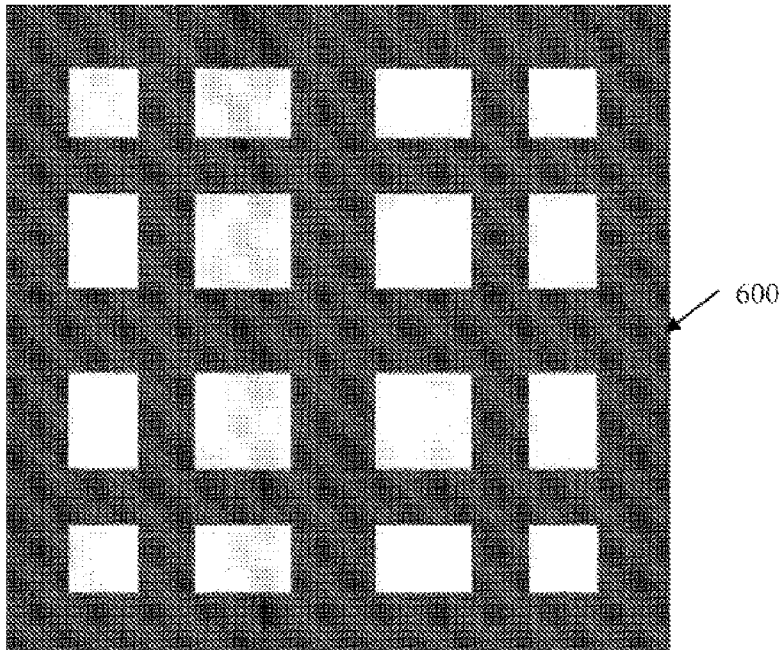

FIGS. 5 and 6 show materials 500 and 600 respectively in which the same type of pattern is adapted to low frequencies (wider patterns, greater wavelengths).

Effective absorption over a wide range of frequencies may easily be obtained by stacking the different layers illustrated in FIGS. 1 to 6, depending on the frequencies to be attenuated and on the desired attenuation.

Figure 7:
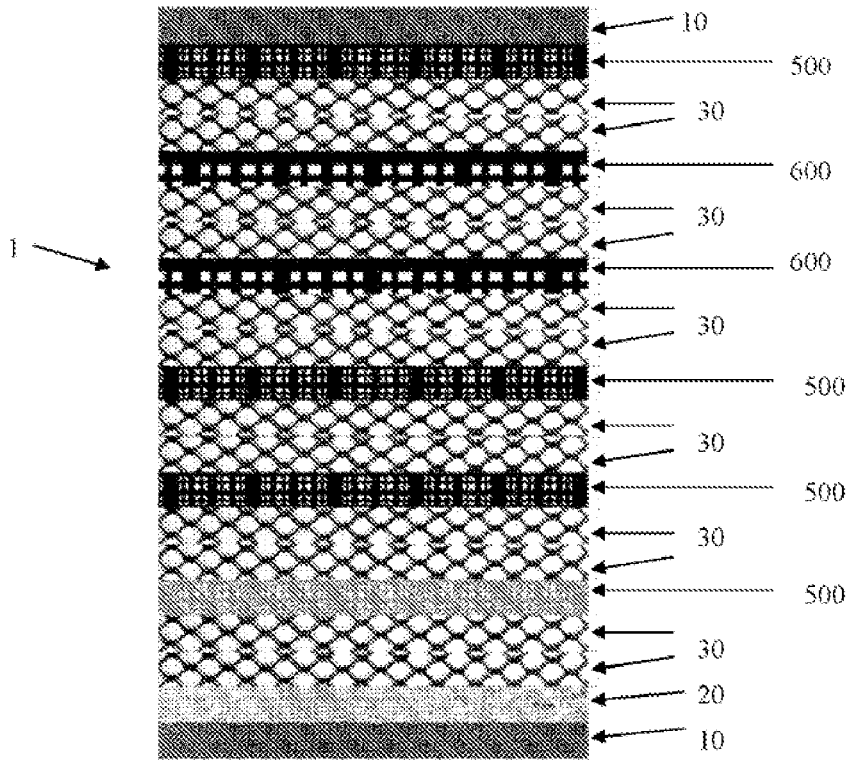
FIGS. 7 and 8 are respectively cross-sectional and perspective views of a material according to the invention having several printed layers laid out together.
Figure 8:
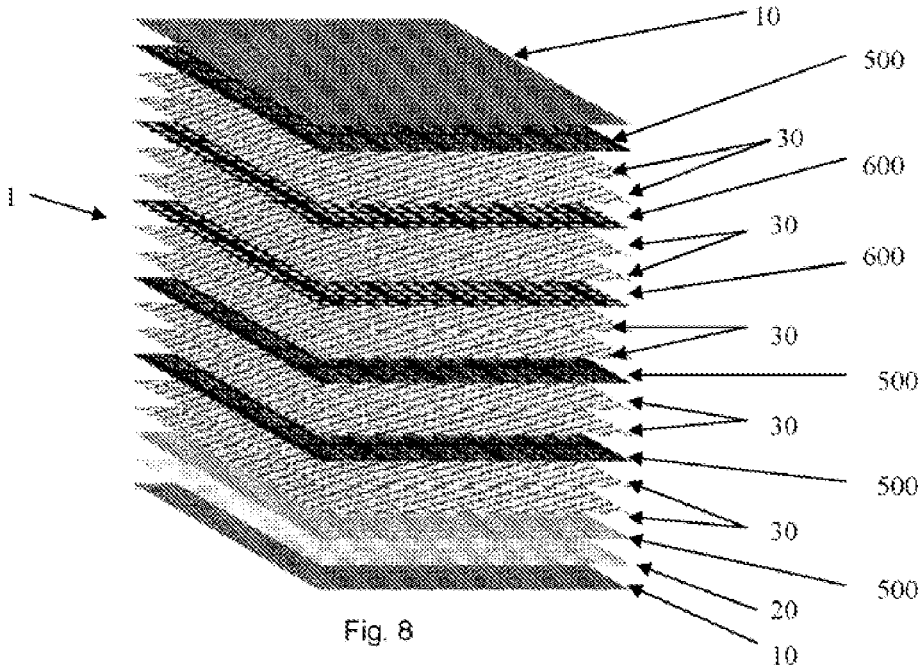

FIGS. 7 and 8 show an exemplary stack giving the possibility of obtaining an absorbing material 1 which may absorb up to 95% of radio frequency energy over a wide band of frequencies.

To do this, the material 1 comprises a plurality of layers positioned between outer shell layers 10.

From the outside, the surface of incidence of the waves to be attenuated, as far as the inside, the layers are positioned as follows:

- a first layer of a material 500 of the type of the one of FIG. 5,
- two netted separation layers 30 each having a thickness of 0.14 mm. These layers notably being of the tulle type, for example,
- a layer of a material 600 of the type of that of FIG. 6,
- two netted separation layers 30
- a new layer of a material 600 of the type of that of FIG. 6,
- two netted separation layers 30
- a new layer of a material 500 of the type of that of FIG. 5,
- two netted separation layers 30
- a new layer of a material 500 of the type of that of FIG. 5,
- two netted separation layers 30
- a new layer of a material 500 of the type of that of FIG. 5, positioned in such a way that its printed face is oriented towards the inside of the material, while the previous printed layers had a printed face oriented outwards (surface of incidence) from the material,
- two netted separation layers 300
- a bulk mylar supporting layer 20 (for example) having a thickness of 0.12 mm.

The total thickness of the material is therefore of about 3.12 mm to which should simply be added the thicknesses of the outer shell layers 10.

The multilayer material therefore remains not very thick, and retains the flexibility of the textiles with which it is made up.

Figure 9:
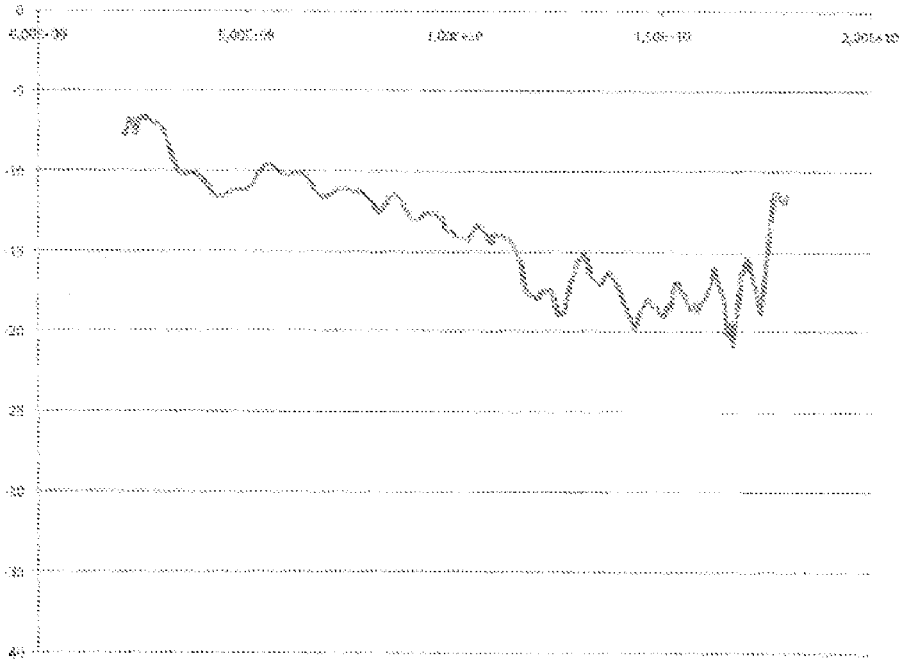
FIG. 9 is a graph of the performance of the material of FIGS. 7 and 8 showing the absorption in decibels versus the wave frequency.

FIG. 9 shows the performances of such a material according to FIGS. 7 and 8.

Of course, the multilayer material 1 illustrated in FIGS. 7 and 8 is only given as an example, any combination and association of printed layers, both in number and in type being possible depending on the sought performances.

Moreover, the material 1 illustrated in FIGS. 7 and 8 shows each printed layer alternating with two spacing layers 30, it is quite obvious that the printed layers may optionally be adjacent, or separated by a more or less large number of spacing layers.

Such a material may be used in many applications.

As mentioned earlier, provision may notably be made for applications in telecommunications and notably for providing screens against electromagnetic waves from mobile GSM telephony. For example, the material according to the invention may be used in a box around the antenna in order to attenuate or even suppress the rear and lateral lobes of these antennas while retaining the integrity of the main beam, or even by improving its quality by suppressing interferences.

It is also possible to use these materials for protecting electronic equipment, notably in land, nautical or airborne vehicles, for example. Thus, it is possible to reduce the electromagnetic susceptibility of the equipment in the vehicle and provide electromagnetic protection to passengers close to the pieces of emission equipment, notably aerial equipment such as amplifiers, antennas, etc.

The material according to the invention may further be used with view to reducing electromagnetic interferences and radar perturbations, for example generated by rotating wind turbines.

Indeed, wind turbines interfere notably with civil aviation and meteorological radars.

A modern wind turbine has a radar equivalent surface area which may be as much as 1,000 $m^2$, or even more. It is therefore understood that a wind turbine farm may cause significant radar perturbations and notably a masking effect, i.e. loss of detection behind the obstacle formed by the wind turbine due to the physical masking of the propagation of electromagnetic waves and to false alarms (false echoes, multiple paths, etc. . . . ).

Such problems may be processed with software by modifying the software package of the radar so as to take such obstacles into account but this causes a significant decrease in the radar detection performances.

Radar absorbing materials capable of absorbing electromagnetic waves over such a wide band of frequencies, presently available commercially, are too heavy and thick. They then have an impact on the performances of the actual wind turbines.

Refusals for installing wind turbines are generally the consequence.

Thus, a material according to the invention may be used for covering the portions of the pylon and of the nacelle of the wind turbine, reflecting electromagnetic waves. A particular application of the invention may comprise wrapping the material around, notably an anti-lightning conducting metal cable fitting out the vanes of the wind turbine as well as around any portion generating a radar signature.

Figure 10:
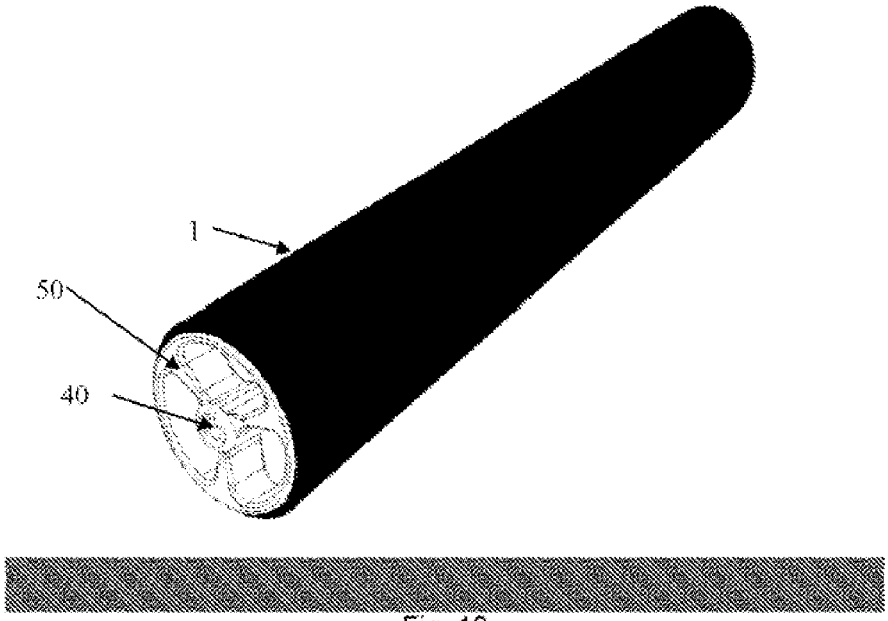
FIG. 10 is a partial schematic illustration of a wind turbine lightning down-conductor having an outer sheath made from a material according to the invention.

As this is illustrated in FIG. 10, the material 1 may surround the conducting cable 40 as a sheath. Alternatively, it is possible to adhesively bond a layer of the material internally on the walls of the vanes.

Advantageously, sufficient space will be provided, advantageously of the order of 10 cm between the material sheath 1 and the cable 40 so that, in the case of lightning, the electric current flowing down the cable (with an intensity from 100,000 to 200,000 amperes) does not exceed the dielectric breakdown limit of air (of the order of 30,000 volts per centimeter). For this purpose, provision may notably be made for insulating spacers 50 which may for example be made in polyoxomethylene having an electric resistivity of the order of 149,000 V per mm.

Further, the material may be used internally in an actual wind turbine vane without having to modify its structure. It may also be used from the start as a constituent of a composite material with which the vanes or other components may be manufactured.

Another possible application is in the field of medical magnetic resonance imaging (MRI). MRI technology suffers from the forming of false images, observable images which do not have any anatomic reality. Such defects may be avoided or minimized by using for example a cover made in a material according to the invention. Such a cover gives the possibility of selectively shielding various portions of the body of the patient. The use of such a cover may also allow protection of the implants present in certain patients against heating up due to radio frequencies.

Although the invention has been described with a particular exemplary embodiment, it is quite obvious that it is by no means limited thereto and that it comprises all the technical equivalents of the means described as well as combinations thereof, if the latter enter the scope of the invention.

The invention claimed is:

1. A material absorbing electromagnetic waves, comprising at least one substantially non-conducting textile layer, printed by means of at least one conductive ink according to at least one pattern comprising printed areas and non-printed areas according to an arrangement adapted to a corresponding range of absorption frequencies; wherein the printed pattern results from intersected printing of lines with determined thicknesses, spaced apart along at least two directions.

2. The material according to claim 1, wherein the conductive ink is an ink based on carbon black.

3. The material according to claim 1, wherein the printed layer has a conductivity comprised between 300 and 1,000 ohms per square.

4. The material according to claim 1, wherein the printed pattern of the fabric is a recurrent pattern.

5. The material according to claim 1, wherein the non-printed areas form rectangles.

6. The material according to claim 1, wherein the printed textile is a non-woven textile.

7. The material according to claim 1, wherein the printed textile is a microfiber textile.

8. The material according to claim 1, wherein the textile is a textile with polymeric fibers.

9. The material (1) according to claim 1, further comprising a plurality of printed layers according to patterns different from each other.

10. The material according to claim 9, wherein the printed layer(s) is(are) printed on a surface intended to receive an incident flux of electromagnetic waves.

11. The material according to claim 1, further comprising at least one dielectric supporting layer intended to be positioned inside the material, the received electromagnetic waves being intended to first cross the printed layer(s).

12. The material according to claim 11, wherein the supporting layer is a polymeric film of the polyethylene terephthalate type.

13. The material according to claim 11, wherein the supporting layer is made from a ventilated three-dimensional textile.

14. The material according to claim 11, wherein the supporting layer is able to be electrically powered with a low voltage.

15. The material according to claim 11, wherein the supporting layer is impregnated with at least one conducting material.

16. The material according to claim 1, further comprising at least one outer shell layer of the polyamide textile type.

17. The material according to claim 1, further comprising at least one printed layer which is printed on a surface intended to be oriented towards the inside of the fabric.

18. The material (1) according to claim 1, wherein all or part of the adjacent printed layers are separated from each other by at least one intercalary spacing layer.

19. The material according to claim 18, wherein the intercalary spacing layer is a cellular layer.

20. A composite material, comprising at least one material according to claim 1.

21. A device comprising at least one surface covered with at least one material according to claim 1.

* * * * *